United States Patent [19]

Richter

[11] 4,111,797

[45] Sep. 5, 1978

[54] METHOD AND APPARATUS FOR SEPARATING PARTICULATE MATERIALS OF DIFFERENT SPECIFIC GRAVITIES

[76] Inventor: Marvin J. Richter, Box 8, R.R. #2 West Coast Rd., Sooke, B.C., Canada, VOS INO

[21] Appl. No.: 750,707

[22] Filed: Dec. 15, 1976

[51] Int. Cl.[2] ..... B03B 5/48; C22B 11/12

[52] U.S. Cl. ..... 209/14; 209/38; 209/40; 209/44; 209/464

[58] Field of Search ..... 209/13–18, 209/38–40, 42–44, 284, 288, 397, 458, 460, 461, 463, 464, 477, 483, 497, 507

[56] References Cited

U.S. PATENT DOCUMENTS

| | | | |
|---|---|---|---|
| 149,127 | 3/1874 | Hinckley | 209/16 |
| 470,921 | 3/1892 | Shill | 209/16 |
| 629,947 | 8/1899 | Beaverstock | 209/44 |
| 738,408 | 9/1903 | Camp | 209/284 X |
| 1,256,764 | 2/1918 | Bagley | 209/42 |
| 1,514,807 | 11/1924 | Tweedy | 209/42 X |
| 1,885,717 | 11/1932 | Harris | 209/40 |
| 2,272,005 | 2/1942 | Hudson | 209/458 |
| 2,355,050 | 8/1944 | Borton | 209/288 X |

*Primary Examiner*—Frank W. Lutter
*Assistant Examiner*—Ralph J. Hill
*Attorney, Agent, or Firm*—Fetherstonhaugh & Company

[57] ABSTRACT

A movably mounted receptacle having perforations therein with hollow spigots connected to the receptacle in registry with the perforations and projecting substantially downwardly therefrom, these spigots being moved through a bed of the particulate material in a receiver while particles of the material move through the spigots. The spigots discharge the particles moving therethrough into the bed and agitate the bed during movement therethrough. A fluid medium is directed in the materials in the receptacle, this medium going through the spigots with the material particles and overflowing from the receiver, carrying lighter particles with it while heavier particles concentrate towards the bottom of the bed. The separating method involving the use of this apparatus.

15 Claims, 7 Drawing Figures

METHOD AND APPARATUS FOR SEPARATING PARTICULATE MATERIALS OF DIFFERENT SPECIFIC GRAVITIES

This invention relates to a method and apparatus for separating particlate materials of different specific gravities, and particularly for separating minerals from sand, gravel and ores.

Although many different materials in particlate form and of different specific gravities can be separated by this method and apparatus, it is particularly designed for separating gold and platinum from sand, gravel and/or ground ores, and for the sake of convenience is so described herein.

There are many devices in the prior art for separating gold and platinum from other materials, such as sand, gravel and ores, but many are of complicated and extensive construction, or if they are not so, they lose a lot of the precious metals during operation. The difficulty is to get small particles of high specific gravity separated from larger particles of lower specific gravity. Considerable separation does take place in the prior art devices, but there usually is a very high percentage of the lighter particles, and these tend physically to move some of the heavier particles with them as they are discharged from the apparatus.

The main purpose of the present invention is to effect a separation of the particles of different specific gravities in such a way that it is almost impossible for the lighter particles to take heavier particles with them out of the apparatus.

The basic idea is to separate the particles of different specific gravities in a space by gravity, depositing the heavier particles into a bed of the particlate material while allowing the lighter particles to remain in the upper part of the bed, and allowing the latter particles to eventually spill out of the bed. While this action is taking place, the bed is constantly agitated in order to assist the concentration of the heavier particles at the bottom thereof.

The method according to the present invention of separating materials of different specific gravities, comprises maintaining a bed of the materials to be separated by moving substantially vertical hollow spigots through the material bed and directing materials for separation downwardly through the spigots towards the bottom of the bed, said materials tending to separate during the drop in the spigots and being discharged from the spigots downwardly of the material bed, said spigots agitating the bed during movement therethrough, and allowing lighter materials to overflow from the bed while heavier materials concentrate towards the bottom of the bed.

More specifically, the present method comprises separating relatively large particles of high specific gravity materials from the remainder of the materials to be separated while mixing a fluid separating medium with the materials, directing the remainder of the materials and separating medium downwardly through substantially vertical hollow spigots being moved through a bed of said materials, said materials tending to separate during the drop in the spigots and being discharged from the spigots downwardly of the material bed, said spigots agitating the bed during movement therethrough, and allowing lighter materials to overflow from the bed while heavier materials concentrate towards the bottom of the bed.

Apparatus is accordance with this invention comprises a receptacle mounted for movement and having a plurality of perforations therein spaced from each other, said receptacle receiving the materials to be separated and said perforations permitting relatively small particles of said materials to pass therethrough during movement of the receptacle, hollow spigots connected to the receptacle in registry with perforations thereof and projecting substantially downwardly therefrom, and a receiver beneath said spigots to receive the particles therefrom in a bed and having a bottom outwardly from ends of the spigots, the material particles tending to separate during movement through the spigots, said spigots discharging the particles moving therethrough towards said bottom and agitating the bed during movement therethrough.

Preferred forms of the apparatus for carrying out the method of the present invention are illustrated in the accompanying drawings, in which.

Figure 1:
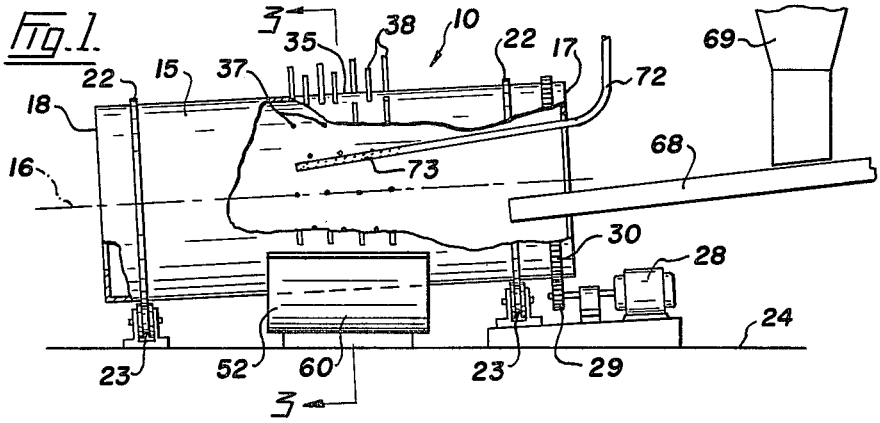
FIG. 1 is a slide elevation of the separating apparatus.
Figure 2:
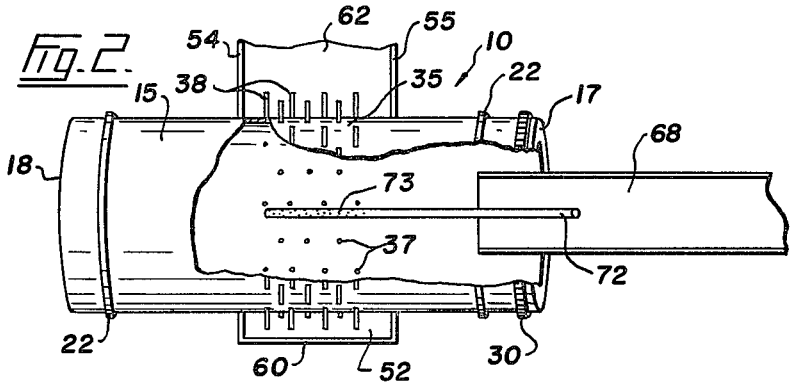
FIG. 2 is a plan view of the apparatus.
Figure 3:
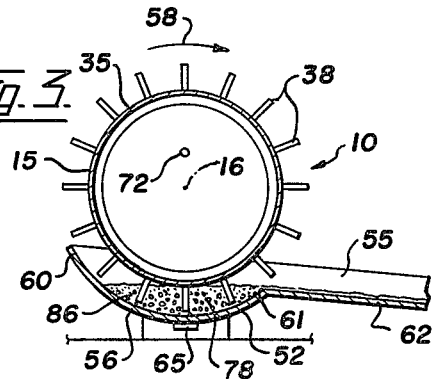
Figure 4:
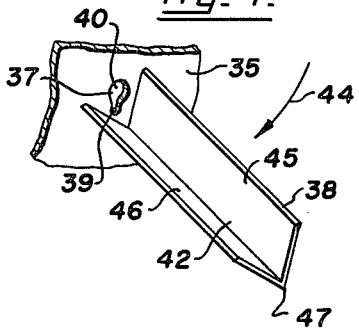
Figure 5:
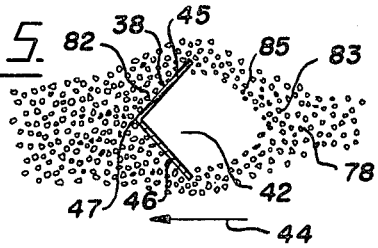
Figure 6:
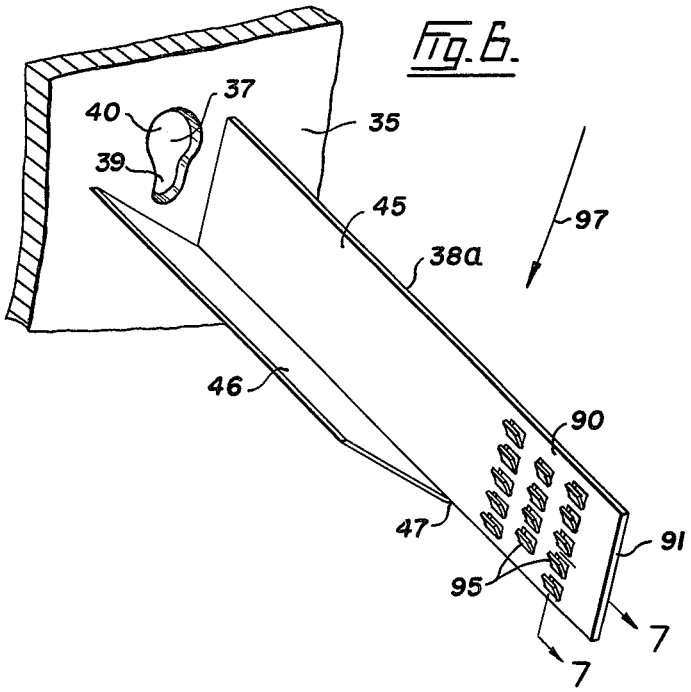
Figure 7:
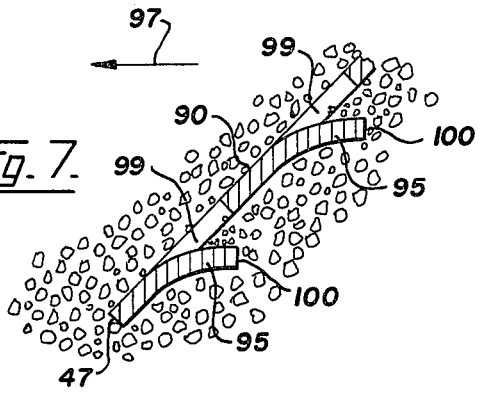

FIG. 3 is a cross section through the apparatus taken on the line 3—3 of FIG. 1, FIG. 4 is an enlarged perspective view of one form of spigot for this apparatus, FIG. 5 diagrammatically illustrates the operation of the spigot of FIG. 4 as it moves through the material bed, FIG. 6 is an enlarged perspective view of an alternative form of spigot for this apparatus, and FIG. 7 is a further enlarged section taken on the line 7—7 of FIG. 6.

Referring to the drawings, 10 is separating apparatus in accordance with this invention which includes as inclined cylindrical drum 15 mounted to rotate around a central longitudinal axis 16 and having an intake end 17 and a discharge end 18. The drum can be mounted in any desired manner. In this example, the drum has outer rings 22 fitted thereon near its opposite ends, these rings riding on rolls 23 mounted on a suitable base 24. Power is applied to the drum to rotate the latter, and in this example, an electric motor 28 drives a pinion 29 meshing with a large gear 30 secured to the drum near the intake end 17 thereof.

Drum 15 is formed with an annular wall section 35 spaced downstream from its intake end 17. This wall section has a plurality of spaced perforations 37 formed therein, and a plurality of hollow spigots 38 are secured to the outer surface of the wall section and in registry with these perforations. Although perforations 37 may be of any desired shape, they are preferably of keyhole shape, as shown in FIG. 4. Each of these perforations has a small end 39 merging with a large end 40. The spigots radiate from the drum surface, and although they may be of tubular construction, each one is preferably formed with an open side 42, as clearly shown in FIG. 4. This open side faces in the direction opposite to the direction in which the spigot moves during operation, the direction of movement being indicated by arrow 44. In this example, each spigot 38 has two walls 45 and 46 inclined to each other in V formation with the edge 47 of the V constituting a leading edge and facing in the direction of the spigot movement.

A concentrating receiver or bin 52 is mounted beneath drum 15 and in line with wall section 35 thereof. This receptacle or bin is open-topped, as clearly shown in FIG. 3, and has side walls 54 and 55 which reach up towards but are clear of the peripheral wall of the drum.

Although not absolutely necessary, bin 55 preferably has a curved bottom 56 which curves substantially around the central axis 16 of the drum and is spaced beyond the ends of spigots 38 which move through the bin in the direction indicated by arrow 58 in FIG. 3. Bottom 56 continues upwardly at one end to form an end wall 60 which extends upwardly above the level of the opposite end wall or edge 61 of the bottom. A discharge chute 62 is connected to and extends outwardly and downwardly from bin edge 61.

Bin 52 is positioned so that the spigots 38 travel therethrough during rotation of drum 15, these spigots entering the bin at end wall 61 and leaving the bin at end wall 60, as clearly shown in FIG. 3. In this example, the outer or free ends of spigots 38 travel through the bin just above the surface of bottom 56 thereof. If desired, a magnet 65 may be attached to the bottom of the bin centrally thereof.

The particlate materials of different specific gravities to be separated in apparatus 10 are directed into drum 15 through the intake end 17 thereof in any desired manner. In this example, a chute 68 is provided for this purpose. This chute is inclined and extends through intake end 17 so as to discharge the material on the inner surface of the rotating drum. The materials may be fed to chute 68 from a hopper 69.

A fluid separating medium is directed into drum 15 in any desired manner, such as by a pipe 72 which extends through the intake end into the drum and has a perforated inner section 73 which extends into and through the wall section area 35 of the drum. The fluid medium may be air, but for most purposes it is preferably a liquid, such as water, pipe 72 being connected to a suitable source of air or water, not shown.

When apparatus 10 is in operation, the particulate material containing particles of different specific gravities, such as mineral-bearing sands, gravels and ores, is directed by chute 68 into drum 15 at the end 17 thereof. As the drum is inclined and is rotating, the materials tumble down the drum. Relatively large particles separate from the smaller particles and move down the drum to be discharged through end 18 thereof. The smaller particles of a predetermined size, this size depending upon the size of the perforations 37, drop down through the perforations into spigots 38. If particles jam in the small end 39 of a perforation 38, other particles will tend to shift the jammed particles to the rear into the large end 40 to free the latter particles. As the spigots extend substantially downwardly as they travel through bin 52, the particles travel downwardly through the spigots and are discharged in a bed 78 of the particles formed in the bin. From FIG. 3 it will be seen that the spigots discharge near the bottom of the bed in the bin.

As the particles travel downwardly through the spigots, the particles of higher specific gravity travel the fastest and usually move the full length of the spigot. Thus, a separation by gravity takes place in the spigots themselves although the latter are moving through a bed of the particles.

FIG. 5 illustrates the action of a spigot 38 as it travels through the bed 78 of the materials being separated. The edge 47 of the spigot leads it through the material so that the particles are separated by the spigot as indicated at 82 and then the particles tend to flow back in behind the spigot as indicated at 83. The walls 45 and 46 of the spigots act as baffles or deflectors which direct the particles laterally relative to the spigots as they move therethrough. In effect, the spigot forms within itself a low pressure area 85 which tends to pull particulate material from the bed back into the spigot. The outer surfaces of the walls or baffles 45 and 46 press the particles together during movement therethrough, and then there is a release of the pressure as these particles round the rearward edges, with reference to the direction of movement of the spigot, so that the particles tend to separate from each other. This ensures separation of the large and small particles so that neither carries the other in the wrong direction. In other words, the small particles do not carry larger particles upwardly with them, and the larger particles do not carry the small particles downwardly. Thus, the particles are subjected to a separating action at each spigot.

As stated above, materials of different specific gravities in the spigots are separated from each other. In other words, each spigot as it passes through the bed forms a substantially vertical channel therein within which the heavier materials are separated from the lighter materials by gravity, and the heavier materials are planted or deposited in the layer indicated at 86 in FIG. 3 formed on the bottom 56 of bin 52. The lighter particles tend to build up on top of this heavier particle layer. As the separating medium or water flows downwardly through the spigots and discharges near the botton of bed 78, this medium or water flows upwardly through the bed to take lighter materials with it and overflows from the bin into chute 62 carrying lighter particles out of the concentrating bin.

If magnet 65 is employed, it attracts metallic particles to the bottom of the bin. If desired, mercury may be placed in bin 52 to amalgamate with the gold in the bed.

FIGS. 6 and 7 illustrate an alternative form of spigot **38*a* for separating apparatus 10. In this example, walls 45 and 46 of the spigot are shorter than the corresponding walls of spigot 38, but are long enough to enter the upper portion of the particle bed 78 in receiver 52 during rotation of drum 15**.

In this example, the wall or baffle 45 is formed with an extension 90, which extends below the outer end of wall or baffle 46. The outer or lower edge 91 of this extension preferably just clears the bottom 56 of the receiver 52. Wall extension 90 is formed with a plurality of baffles 95 which are inclined inwardly relative to the wall and spigot, see FIG. 7, so that they are inclined transversely of the direction of travel of the spigot, which is indicated by arrow 97. These baffles are relatively small, and form a plurality of comparatively low pressure areas 99 at their rear edges 100, with reference to the direction of movement of the spigot.

When a spigot **38*a* moves through the particulate bed 78, the walls 45 and 46 act in the same manner as the corresponding walls of spigot 38 described above, the only difference being that the walls of spigot 38*a* do not extend down to near the bottom of the particulate bed. These walls of spigot 38*a* form a channel through which particles entering the spigot from the adjacent perforation 37 can travel. Separation of the large and small particles takes place in this portion of the spigot. In addition to this, as the walls extension 90 travels through the particulate bed, the baffles 95 provide the low pressure areas 99 behind them so that particles of the bed flow around the rear edges 100 of these baffles into these areas. As stated above relative to walls 45 and 46 of spigot 38, the baffles 95 as they travel through the particles press these together and then there is a release of this pressure as the particles round the rearward edges of the baffles, so that the particles tend to separate from each other. In other words, the baffles 95 provide a multitude of separating areas at the wall extension 90. The particulate material is alternatively subjected to pressure and pressure release in a large number of areas at wall extension 90**, and this practically eliminates the possibility of small particles flushing larger particles towards the top of the particulate bed, or large particles moving smaller particles clinging to them downwardly towards the bottom of the bed. With this arrangement, a very good stratification of the particles in accordance with their size or specific gravity takes place in a relatively shallow particulate bed.

The following are some particulars of an example of apparatus that is suitable for this separating operation, but it is to be understood that these are representative only, and that the apparatus is not limited to these:

| | |
|---|---|
| drum- | 17 feet long, 52 inches in diameter. |
| drum speed | about 3 rpm. |
| drum incline- | about 3 inches per lineal foot. |
| lengths of spigots- | from 10 inches at upstream end of drum down to 6 inches. |
| spigot walls- | about 1 inch wide with their rear edges about 1½ inches apart. |
| receptacle- | 48 inches wide (length wise of drum) and spanning ⅓ of the drum circumference. |
| wall extension and baffles- | this is similar to what is generally known as expanded metal. |

An advantage of apparatus 10 is that it can be operated without a fluid separating medium. The large particles are separated out by drum 15, and the smaller particles will drop through apertures 37 and through spigots 38 or 38*a* under the action of gravity alone. The separation of particles of different specific gravities within the spigots is the same as described above. However, for most purposes, and for quicker action, it is desirable to spray water into drum 15.

It is also possible to use air as the fluid separating medium. The air acts as a conveying medium and helps to separate out very light materials, while the apparatus separates the remaining materials of different specific gravities from each other.

Although it is preferable that receptacle 15 be in the form of a cylindrical drum, as shown, it could be in the form of a vibrating trough with spigots projecting downwardly from apertures therein, or it could be in the form of a container rotating around a vertical axis, in which case the apertures would be in the bottom of the container and the spigots would project downwardly therefrom. The main thing is that articles of a predetermined maximum size drop downwardly through the spigots where separation can take place under the action of gravity, and the spigots move through a bed formed of the particles to stir up the bed, which in itself constitutes in a separating operation, and provides the low pressure areas into which particles of the bed move for further separation. The heavier particles are deposited at or near the bottom of the bed so that a very large percentage of these particles do not have to work their way through the bed itself.

I claim:

1. Apparatus for separating particulate materials of different specific gravities, comprising an inclined drum mounted for rotation around a longitudinal axis and having an intake end and a discharge end, means for directing said particulate materials and water into the drum through the intake end thereof, an annular wall section in the drum having a plurality of perforations therein and spaced from each other, relatively small particles of said materials passing through the perforations during rotation of the drum, hollow spigots connected to the drum and registering with said perforations and radiating therefrom, each spigot having an open side facing in the direction opposite to the direction in which the drum rotates, an open concentrate bin beneath said wall section of the drum to receive the particles from the spigots in a bed of materials, the material particles tending to separate during movement through the spigots, said spigots being long enough to reach into the bed of particles to discharge the particles moving through the spigots into the bed and agitating said bed during movement therethrough, and said water traveling through the spigots and overflowing from the bin and removing therewith lighter particles while heavier particles concentrate towards the bottom of the bin.

2. Apparatus as claimed in claim 1 in which said concentrate bin has a curved bottom, the curve of which extends in the direction of rotation of the drum, said bottom being radially spaced a little from outer ends of the spigots in the bed.

3. Apparatus as claimed in claim 1 in which said concentrate bin has a bottom curved substantially around said axis of the drum, said bottom being radially spaced a little from outer ends of the spigots in the bed.

4. Apparatus as claimed in claim 1 in which each spigot has at least one baffle inclined transversely of the direction of travel of the spigot.

5. Apparatus as claimed in claim 4 in which at least one of said baffles of each spigot is inclined opposite to the incline of at least one other of said baffles.

6. Apparatus as claimed in claim 1 in which each spigot has a plurality of baffles inclined transversely of the direction of travel of the spigot.

7. Apparatus as claimed in claim 1 in which each perforation of the receptacle is of keyhole shape.

8. Apparatus as claimed in claim 1 in which each perforation of the receptacle is of keyhole shape and has a small end and a large end, said small end being ahead of the large end with reference to the direction of movement of the spigots.

9. Apparatus as claimed in claim 1 in which each spigot has an open side facing the direction opposite to the direction in which the spigot moves through the bed of materials in the receiver.

10. Apparatus as claimed in claim 1 in which each spigot is V-shaped in cross section with the edge of the V thereof facing in the direction in which the drum rotates.

11. Apparatus as claimed in claim 1 in which each spigot includes a wall extending therefrom away from the receptacle, each of said walls having a plurality of baffles inclined outwardly therefrom and transversely of the direction of travel of the spigot.

12. Apparatus as claimed in claim 1 in which each spigot comprises two walls arranged in cross section in V-shape configuration with the edge of the V thereof facing in the direction in which the receptacle moves, one of said walls of said each spigot having an extension projecting outwardly away from the receptacle, and said wall extension having a plurality of of baffles inclined outwardly therefrom and transversely of the direction of travel of the spigot.

13. Apparatus for separating particulate materials of different specific gravities, comprising an inclined drum mounted for rotation around a longitudinal axis and having an intake end and a discharge end, an annular wall section in the drum having a plurality of perforations therein and spaced from each other, relatively small particles of said materials passing through the perforations during rotation of the drum, hollow spigots connected to the drum and registering with said perforations and radiating therefrom, each spigot having an open side facing in the direction opposite to the direction in which the drum rotates, means for spraying water on to the materials in the drum, and an open concentrate bin beneath said wall section of the drum to receive the particles from the spigots in a bed of materials, the material particles tending to separate during movement through the spigots, said spigots being long enough to reach into the bed of particles to discharge the particles moving through the spigots into the bed and agitating said bed during movement therethrough, and said water traveling through the spigots and overflowing from the bin and removing therewith lighter particles while heavier particles concentrate towards the bottom of the bin.

14. Apparatus as claimed in claim 13 including a magnet at the bin for attracting thereto metal particles in the bin bed.

15. Apparatus as claimed in claim 13 including mercury in the bin for removing predetermined particles of the material in the bin.

* * * * *